United States Patent [19]

Nagashima

[11] Patent Number: 4,835,868

[45] Date of Patent: Jun. 6, 1989

[54] SAW CHAIN TENSIONER OF CHAIN SAW

[75] Inventor: Akira Nagashima, Kawasaki, Japan

[73] Assignee: Kioritz Corporation, Tokyo, Japan

[21] Appl. No.: 131,836

[22] Filed: Dec. 11, 1987

[30] Foreign Application Priority Data

Dec. 17, 1986 [JP] Japan ..... 61-194299[U]

[51] Int. Cl.[4] ..... B27B 17/14

[52] U.S. Cl. ..... 30/386; 83/816

[58] Field of Search ..... 30/383, 385, 386, 387; 83/814, 816; 474/101, 109, 111, 136

[56] References Cited

U.S. PATENT DOCUMENTS 2,624,379 1/1953 Arneson .
2,765,821 10/1956 Strunk .
2,767,746 10/1956 Adams ..... 30/386
2,774,395 12/1956 Tweedie .
2,775,826 7/1956 Kiekhaefer .
2,933,112 4/1960 Bentley et al. .
3,194,284 7/1965 Walker et al. .
3,267,973 8/1966 Beard ..... 30/386
3,382,898 5/1968 Walker .
3,435,859 4/1969 Walker et al. .
3,866,320 2/1975 Progl ..... 30/386

*Primary Examiner*—Frank T. Yost
*Assistant Examiner*—Eugenia A. Jones
*Attorney, Agent, or Firm*—Browdy and Neimark

[57] ABSTRACT

A saw chain tensioner of a chain saw having a threaded rod member provided with a flange portion extending radially outwardly therefrom and adapted to be engaged by an engaging portion formed on a side plate which is disposed between a chain guide bar and a frame of the chain saw.

3 Claims, 1 Drawing Sheet

SAW CHAIN TENSIONER OF CHAIN SAW

BACKGROUND OF THE INVENTION

The present invention relates to a saw chain tensioner for imparting a suitable level of tension to the saw chain of a chain saw.

A known saw chain tensioner has a threaded rod member rotatably received in a hole in the frame of a chain saw, a clip or a special lock nut fixed to the threaded rod so as to prevent the threaded rod from coming off the chain saw frame when the threaded rod is moved axially as a result of rotation, and a pin member screwed onto the threaded portion of the threaded rod member and having a portion which is extended through a lateral guide slot formed in a side plate which is disposed between a chain guide bar and the chain saw frame, the portion being further extended into a slot formed in the chain guide bar. As the threaded rod member is rotated, the pin member is moved back and forth in the axial direction of the threaded rod member so as to displace the chain guide bar in the longitudinal direction thereof, whereby the span of the saw chain is adjusted to control the level of the tension applied to the saw chain.

This type of saw chain tensioner is disadvantageous in that the production cost of the chain saw is raised and the repair or maintenance work is made difficult due to the provision of a clip or a lock nut which is attached to the threaded rod for the purpose of preventing the threaded rod from coming off the frame of the chain saw.

SUMMARY OF THE INVENTION

Accordingly, an object of the present invention is to provide a saw chain tensioner of a chain saw which has a simplified construction and which is easy to handle, thereby overcoming the problem of the known saw chain tensioner.

To this end, according to the present invention, there is provided a saw chain tensioner comprising: a threaded rod member rotatably received in a hole in the frame of a chain saw; and a pin member screwed onto the threaded portion of the threaded rod member and having a portion which is extended through a lateral guide slot formed in a side plate which is disposed between a chain guide bar and the chain saw frame into a slot formed in the chain guide bar, whereby, when the threaded rod member is rotated, the pin member is moved back and forth in the axial direction of the threaded rod member so as to displace the chain guide bar in the longitudinal direction thereof, thereby adjusting the level of tension applied to the saw chain, wherein the improvement comprises a flange portion extending radially outward from the threaded rod member, and an engaging portion formed on the side plate and engaging with the flange portion on the threaded rod member.

In operation, as the threaded rod member is rotated relative to the frame portion and the side plate of the chain guide bar, the pin member is axially displaced so as to cause a movement of the chain guide bar in the longitudinal direction thereof. During this operation, the threaded rod member is prevented from coming off the frame of the chain saw by the mutual engagement between the flange portion on the threaded rod member and the engaging portion of the side plate.

According to the present invention, therefore, it is possible to prevent accidental dropping of the threaded rod member from the frame of the chain saw, without requiring any specific member such as a clip or a lock nut which is necessitated in the prior art chain saw. The threaded rod member may be constituted by a commercially available bolt, so that the saw chain tensioner can be produced easily at a reduced cost.

DESCRIPTION OF THE PREFERRED EMBODIMENT

An embodiment of the present invention will be described hereinunder with reference to the drawings.

Figure 1:
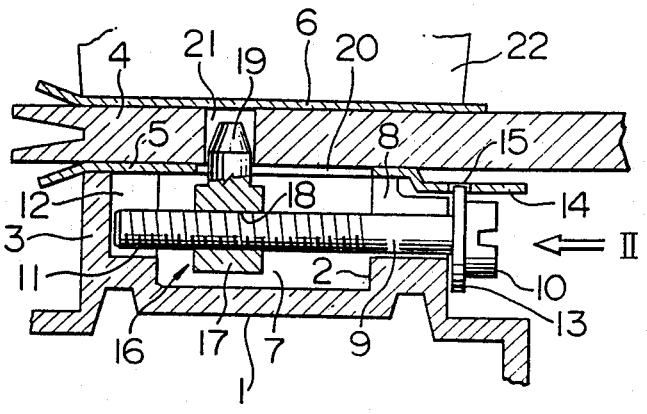
FIG. 1 is a cross-sectional view of an essential portion of an embodiment of a saw chain tensioner in accordance with the present invention.
Figure 2:
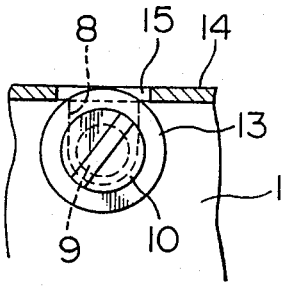
FIG. 2 is an end view of the saw chain tensioner as viewed in direction of an arrow II in FIG. 1.

Referring to FIG. 1, a chain saw incorporating a saw chain tensioner of the present invention has a frame 1 which is provided with a pair of substantially parallel spaced lateral walls 2 and 3 projecting laterally from a main part of the frame 1. A side plate 5 extends between these lateral walls 2, 3 and a chain guide bar 4. Another side plate 6 which is disposed between the side plate 5 and a guide bar retaining member 22 defines both sides of the chain guide bar 4 so as to prevent a saw chain (not shown) from coming off the chain guide bar 4 during running of the saw chain. The chain guide bar 4 is fixed between the chain saw frame 1 and the guide bar retaining member 22 by means of bolts (not shown) which extend through a slot which is formed in the chain guide bar 4 so as to extend in the longitudinal direction thereof. The arrangement is such that, after loosening of nuts (not shown) on the bolts, the chain guide bar 4 is movable in the longitudinal direction thereof relative to the chain saw frame 1, so that the position of the chain guide bar 4 relative to the chain saw frame 1 is adjustable. The chain saw frame 1, the lateral walls 2, 3 and the side plate 5 in cooperation define a rectangular space 7 which is elongated in the longitudinal direction of the chain guide bar 4, A depression 8 is formed in the lateral wall 2 so as to open outwardly of the machine saw chain frame 1 at a front portion of the chain saw frame 1 (right portion as viewed in FIG. 1). A threaded rod member 9 is inserted into the depression 8 and is rotatably supported substantially in parallel with the chain guide bar 4. The threaded rod member 9 has a head 10 which is disposed outside the lateral wall 2 and a threaded portion 11 which is disposed in the above-mentioned space 7. The end of the threaded rod member 9 opposite to the head 10 is rotatably supported in another depression 12 similar to the depression 8 and formed in the rear lateral wall 3.

The threaded rod member 9 has an annular flange portion 13 which is extended radially outwardly from the head 10. Thus, the threaded rod member 9 may be constituted by a commercially available flanged bolt. The front end portion 14 of the side plate 5 adjacent to the annular flange portion 13 is bent towards the annular flange portion 13 and a longitudinal slot 15 as an example of the engaging means is formed in this front end portion 14. The annular flange portion 13 is partially received in the slot 15 so that it can rotate relative to the side plate 5 fixed to the chain saw frame 1. However, the annular flange portion 13 prevents the axial movement of the threaded rod member 9, thus preventing the threaded rod member 9 from coming off the lateral wall 2 of the frame 1.

A pin member 16 is provided at its base end with a threaded hole 18 which meshes with the threaded portion 11 of the threaded rod member 9, whereby the pin member 16 is held by the threaded rod member 9 in screwing engagement therewith. An end 19 projecting laterally from the pin member 16 extends through an elongated slot 20 formed in the side plate 5 into a through hole 21 formed in the guide bar 4. Therefore, the pin member 16 is prevented from rotating about the axis of the threaded rod member 9, although it is allowed to move back and forth in the axial direction of the threaded rod member 9 in accordance with the rotation of the threaded rod member 9.

Although in the described embodiment the engaging portion is constituted by the elongated slot 15, this is only illustrative and the engaging means may be constituted by a tab which is formed by slitting the side plate 5 and raising the tab for engagement with the annular flange 13.

The adjustment of the tension applied to the saw chain is conducted by loosening the nuts on the bolts which fixes the chain guide bar 4 to the chain saw frame 1, and rotating the threaded rod member 9 in a predetermined direction. In consequence, the pin member 16 is moved forward or backward along the threaded rod member 9. If the threaded rod member 9 is rotated in such a direction as to cause the pin member 16 to move forwardly (to the right as viewed in FIG. 1), the chain guide bar 4 also is moved forward so as to increase the span between a chain drive sprocket (not shown) around which the saw chain turns, whereby the saw chain is tensed with a desired level of tension. Then, the nuts are tightened to fix the chain guide bar 4 again to the saw chain frame 1, thereby to maintain the suitable level of tension in the saw chain.

The threaded rod member 9 can easily be removed laterally together with the pin member 16, simply by demounting the chain guide bar 4 and the side plate 5.

What is claimed is:

1. A saw chain tensioner comprising: a threaded rod member rotatably received in a frame of a chain saw; and a pin member screwed onto a threaded portion of the threaded rod member and having a portion which is extended through a lateral guide slot formed in a side plate which is disposed between a chain guide bar and the chain saw frame into engagement with the chain guide bar, whereby, when the threaded rod member is rotated, the pin member is moved back and forth in the axial direction of the threaded rod member so as to displace the chain guide bar in the longitudinal direction thereof, thereby adjusting the level of tension applied to a saw chain wherein the improvement comprises a head (10) at an end of said rod member (9), said head (10) being outside of said frame, a flange portion (13) extending radially outward from the threaded rod member (9) adjacent said head (10), and an engaging portion (15) formed on the side plate and engaging with the flange portion (13) on the threaded rod member (9).

2. A saw chain tensioner comprising a threaded rod member rotatably received within a housing of a chain saw frame; a pin member screwed onto a threaded portion of said threaded rod member within said housing and having a portion which extends through a lateral guide slot formed in a side plate disposed between a chain guide bar and said chain saw frame into engagement with the chain guide bar; said threaded rod member having an end which extends outside of said housing and having a head on said end, said head being directly accessible to a user of the chain saw, said head being configured to directly accept a hand-held tool in order to rotate said threaded rod member about its axis to move said pin member back and forth in the axial direction of the threaded rod member to displace the chain guide bar in the longitudinal direction thereof; a flange portion extending radially outwardly from the threaded rod member; and an engaging portion formed on the side plate and engaging with the flange portion on the threaded rod member.

3. A saw chain tensioner according to claim 2 wherein said head is configured with a slot so as to receive a screw driver as the hand-held tool to rotate said threaded rod member.

* * * * *